US005814896A

United States Patent [19]

Araki

[11] Patent Number: 5,814,896

[45] Date of Patent: Sep. 29, 1998

[54] STARTER WITH PINION ROTATION RESTRICTING STRUCTURE

[75] Inventor: Takeshi Araki, Nishikasugai-gun, Japan

[73] Assignee: Nippondenso Co., Ltd., Kariya, Japan

[21] Appl. No.: 651,591

[22] Filed: May 22, 1996

[30] Foreign Application Priority Data

May 26, 1995 [JP] Japan ..... 7-152675
Mar. 22, 1996 [JP] Japan ..... 8-66020

[51] Int. Cl.[6] ..... F02N 11/00

[52] U.S. Cl. ..... 290/38 R; 290/48

[58] Field of Search ..... 290/38 R, 38 A, 290/38 B, 38 C, 38 D, 38 E, 48; 74/6, 7 R, 8, 9

[56] References Cited

U.S. PATENT DOCUMENTS 1,941,698 1/1934 Lock ..... 290/38

FOREIGN PATENT DOCUMENTS 57-36763 3/1955 Japan .

*Primary Examiner*—Steven L. Stephan
*Assistant Examiner*—Nicholas Ponomarenko
*Attorney, Agent, or Firm*—Cushman Darby & Cushman IP Group of Pillsbury Madison & Sutro LLP

[57] ABSTRACT

A rotation restricting member is driven to engage a pinion moving member by a magnet switch and restricts it to rotate, so that it advances under rotation of an output shaft accompanied with energization of a motor and is engaged with a ring gear. Since it is satisfactory to displace the rotation restricting member in order to cause the pinion restricting member to abut against the pinion moving member under application of residual plunger stroke after both contacts of the magnet switch are abutted, it is not necessary to arrange any resilient member between a plunger and the rotation restricting member, thereby simplifying configuration of the magnet switch.

11 Claims, 2 Drawing Sheets

STARTER WITH PINION ROTATION RESTRICTING STRUCTURE

BACKGROUND OF THE INVENTION

1. Field of the Invention

This invention relates to a starter, and more particularly, a starter in which a rotation of a pinion is restricted by a magnet switch.

2. Related Art

The prior art disclosed in the gazette of Japanese Utility Model Laid-Open No. JP-U 57-36763 shows a starter in which, when a magnet switch is energized to move a plunger thereof together with a movable contact toward a direction of closing switch, the plunger displaces a pinion restricting member through a third spring while it compresses a return spring and causes this member to be abutted against the pinion, so that a rotation of the pinion is restricted. After this operation, the plunger biases the movable contact toward a fixed contact while it compresses the third spring, so that the movable contact is abutted against the fixed contact. A further stroke of the plunger is adapted by a further compression of the third spring and a contact spring.

Although a motor is rotated by the abutting between the movable contact and the fixed contact, the pinion restricting member abuts against the pinion to restrict its rotation, resulting in that the pinion can be moved toward a ring gear of an engine through a helical spline.

However, the aforesaid prior art system has a problem that the third spring must be additionally arranged in magnet switch in order to make a mutual abutment between the movable contact and the fixed contact and so the magnet switch needs a large number of component elements. In addition, the movable contact and the pinion restricting member moved under an operation of the plunger are required to operate while each of the spring forces is being balanced from each other as they causes the contact spring, the third spring (a shaft pushing spring) and the return spring to be flexed in sequence as the plunger was operated. The prior art system has a problem that it is quite hard to set both a pushing force applied when the pinion restricting member restricts a rotation of the pinion and a contact load applied when the movable contact abuts against the fixed contact to the most suitable value due to changes in spring characteristic (a relation between a flexing and a load) and changes in space sizes where each of the springs is stored (changes in component sizes) and the like.

SUMMARY OF THE INVENTION

In view of the foregoing, it is an object of the present invention to provide a starter in which a motion of a pinion toward an engine ring gear can be realized by abutting a pinion restricting member against a pinion moving member by a magnet switch without increasing the number of component parts of the magnet switch.

According to a first aspect of the present invention, a pinion restricting member is abutted against a pinion moving member after a fixed contact and a movable contact in a magnet switch are abutted to each other and before starting a rotation of the pinion moving member. As a result, a pinion (pinion gear) of the pinion moving member fitted in a helical spline with an output shaft advances in response to a rotation of the output shaft as a starter motor is rotated and then the pinion is engaged with the ring gear. Thus, after the pinion restricting member is abutted against the pinion, no additional spring (a third spring) is required between the plunger for abutting the movable contact against the fixed contact in the magnet switch and the pinion restricting member, and the configuration of the magnet switch can be made quite simple.

Since a time delay of about several tens milliseconds is caused between a time of closing of the contact in the starter and a time when the pinion moving member starts to rotate, the pinion restricting member can abut against the pinion moving member before the pinion moving member starts to rotate and control its rotational restriction. As a result, it is possible to dampen a shock occurring when the pinion restricting member abuts against the pinion moving member and to prevent the pinion restricting member from being damaged.

Preferably, in the case that the pinion restricting member abuts against the pinion moving member to restrict the rotation of the pinion moving member, the pinion restricting member is caused to abut in advance against a plurality of grooves formed at a location in the pinion other than those of pinion teeth are provided, the pinion teeth are not damaged under this abutment of the pinion restricting member. In addition, the grooves can perform a positive restriction against rotation by abutting the pinion restricting member. Additionally, since the pinion has various kinds of dimensions for various types of engines, it is possible to arrange the location of abutting the pinion restricting member on the pinion moving member without being influenced by the specification of the pinion teeth and a design specification for this part may become possible in one type of design, resulting in that its manufacturing cost can be reduced.

Preferably, the rotational restriction due to the abutment between the pinion restricting member and the pinion moving member causes the pinion to be moved by a predetermined amount toward a ring gear side, thereafter, the pinion rotation restricting member restricts a retraction of the pinion moving member due to a remaining stroke in the plunger to cause the pinion moving member to abut against it in an axial direction, resulting in that the pinion restricting member restricts the retraction of the pinion moving member after engagement of the pinion with the ring gear, so that it is possible to prevent the pinion from being rapidly returned (an engaged state between the pinion and the ring gear is released).

Preferably, the present invention is applied to a so-called reduction starter in which a motor drives an output shaft through a speed reducing mechanism. In such a reduction type starter, start-up of rotation of the output shaft becomes slow and therefore rotation restricting member for the pinion can abut against the pinion moving member before rotation of the pinion moving member starts to rotate with certainty.

DESCRIPTION OF PRESENTLY PREFERRED EMBODIMENT

Figure 1:
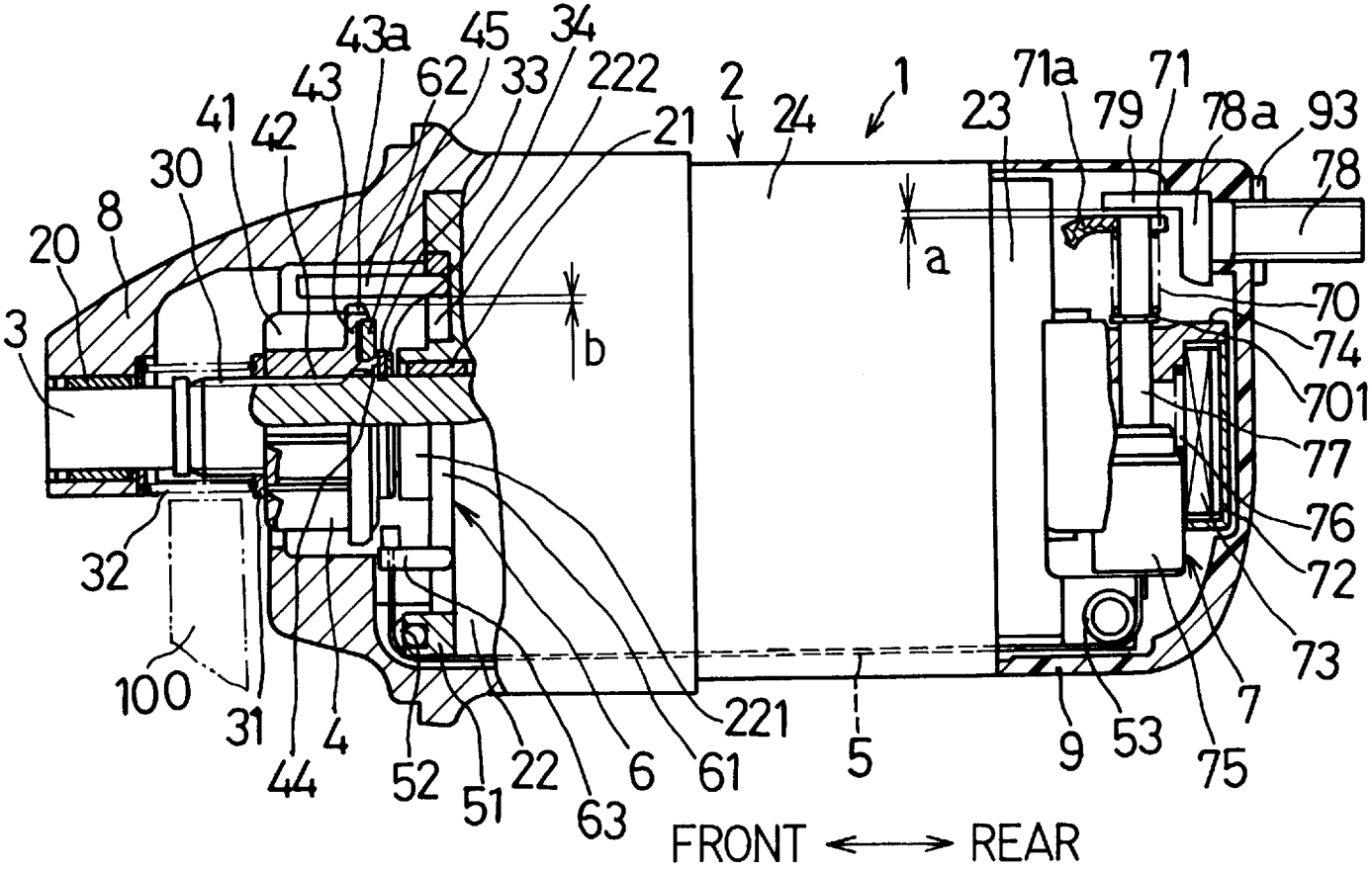
FIG. 1 is an entire sectional view showing a starter according to the present invention.
Figure 2B:
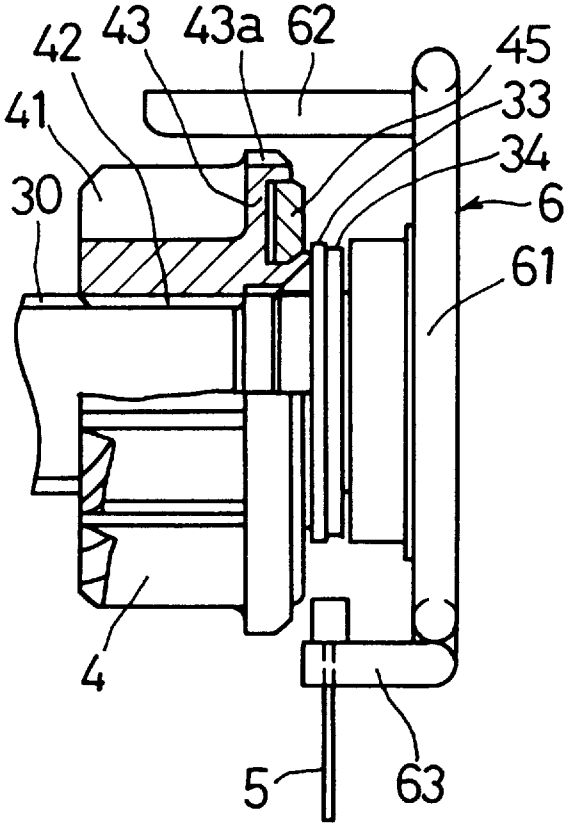
FIG. 2B is an enlarged partial side elevational view showing, in an enlarged form, the pinion and the rotation restricting member.
Figure 2A:
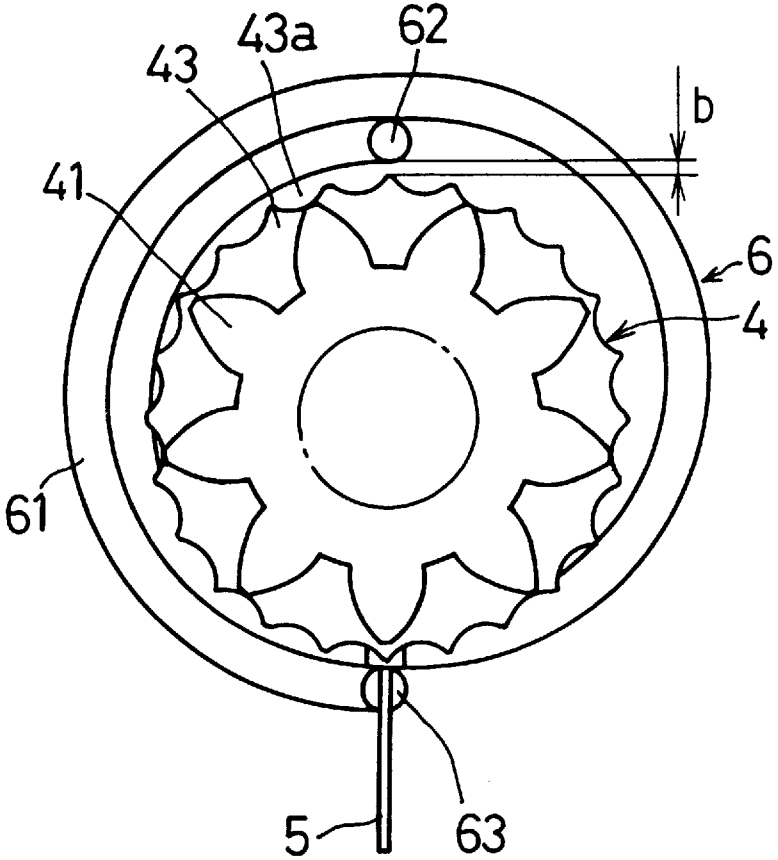
FIG. 2A is a partial enlarged front elevational view showing, in an enlarged form, a pinion and a rotation restricting member shown in FIG. 1.

Referring now to the drawings, an embodiment of a starter according to the present invention will be described.

As shown in FIG. 1, a starter 1 is comprised of a starter motor 2 for generating a rotating force upon receiving an electrical power; an output shaft 3 coaxially arranged with the rotating shaft of the starter motor 2; a planetary decelerating or reduction mechanism (not shown) for transferring a rotational force of the starter motor 2 to the output shaft 3; a pinion 4 fitted on an outer circumference of the output shaft 3; a rotation restricting member 6 (pinion restricting means) for restricting a rotation of the pinion 4 while a pinion gear 41 of the pinion 4 is engaged with the ring gear 100 and advances by a predetermined distance and for restricting a retracting motion of the pinion 4 after the pinion 4 is engaged with a ring gear 100 of an engine; and a magnet switch 7 arranged at a rear side of the starter motor 2. A housing 8 stores the pinion 4 therein, and its rear end part is fastened to the front end of the starter motor 2 by bolts (not shown). To the rear part of the housing 8 is fitted a center case 22 at its rear part, and the center case 22 stores a planetary reduction gear mechanism (not shown) for speed reduction. An end cover 9 encloses the rear end part of the starter motor 2 and the magnet switch 7.

The front end of the output shaft 3 is rotatably supported at the housing 8 through a bearing 20, and the central part of the output shaft 3 is rotatably supported at a bearing part 221 of the center case 22 through a bearing 21. A rear end of the output shaft 3 is fixed to a planet carrier of the planetary decelerating mechanism (not shown) including planetary gears, and a sun gear for this planetary decelerating mechanism is formed on the shaft of an armature (not shown) of the starter motor 2. In addition, the center case 22 is fixed to an inner circumference of the rear end of the housing 8 to enclose the planetary decelerating mechanism. One-way clutch (not shown) is stored in the center case 22 and placed between an internal gear (not shown) of the planetary decelerating mechanism and the center case 22.

The pinion 4 is helical spline-fitted to the front part of the output shaft 3 within the housing 8, an d biased rearwardly by a spring 32 arranged at the extremity end of the pinion 4. The spring 32 axially biases the pinion 4 through a shutter ring 31 fitted on the outer circumference of the output shaft 3 in front of the pinion 4. This shutter 33 is cooperatively operated in response to the motion of the pinion 4 so as to open or close the opening (not shown) opened at the side of the housing 8 facing the ring gear 100. Helical spline grooves 30 are formed on the output shaft 3, and helical spline grooves 42 are formed in the pinion 4.

The rear end of the pinion 4 is formed with a flange 43 which is integral with the rear end of the pinion gear 41; the flange 43 is formed to have a larger diameter than that of the pinion gear 41; and the outer circumferential surface of the flange 43 is formed with many indents on grooves 43*a*. The indents or grooves 43*a* are larger in number than that of the outer teeth of the pinion gear 41.

The pinion 4 has a cylinder 44 extending from the central part of the rear end surface of the flange 43 toward a rear part, and a washer 45 is rotatably mounted on the cylinder 44 just behind the flange 43. An outer periphery of the rear end of the cylinder 44 is bent in a radially outward direction to prevent disengagement of the washer 45. A C-shaped clip 33 is positioned between the pinion 4 and the center case 22 and fitted on the output shaft 3 in such a manner that its axial displacement may not be caused. In addition, the washer 34 is placed at a rear part of the C-shaped clip 33 and rotatably fitted on the output shaft 3. The C-shaped clip 33 is abutted against the bearing part 221 of the center case 22 through the washer 34 so as to define a maximum retracting position of the output shaft 3.

The rotation restricting member (pinion restricting means) 6 is comprised of a ring part 61 formed by a bent metallic rod and wound in a helical form by about 3/2 turns; a long arm part 62 projecting axially and forwardly from inside the ring part 61 to just above the pinion 4; and a short arm part 63 projecting axially and forwardly from its outer end just below the pinion 4. The long arm part 62 is formed to be longer than the short arm part 63.

The front end of the center case 22 has a rotation restricting member guiding groove 222 indented in a form of ring plate at an outer circumference of the bearing 221 at the central part in its radial direction. A ring part 61 of the rotation restricting member 6 is movably fitted in the guide groove 222. The rotation restricting member guiding groove 222 is formed longer at its vertical or radial direction than that at its lateral or axial direction, and the ring part 61 of the rotation restricting member 6 can be slid and displaced vertically in the guide groove 222. The rotation restricting member 6 is normally pulled up to the upper end position shown under an action of a return spring (not shown), and it is constructed such that it is biased and moved down only when the magnet switch 7 to be described later is electrically energized and operated.

As shown in FIG. 1, the magnet switch 7 is held at the rear end of a brush holder 23 arranged at the rear end of the starter motor 2 and stored in the end cover 9 to operate in a vertical direction in FIG. 1.

The magnet switch 7 is comprised of a switch cover 72, a coil 73, a fixed iron core 74, a plunger 75, a return spring 76 and a rod 77 or the like. The switch cover 72 is made of magnetic material, it is press-formed into a cup-shape and its central part of the bottom surface (a lower surface in FIG. 1) is provided with a through hole where the plunger 75 is slidably inserted. The coil 73 is connected to a vehicle-mounted battery (not shown) through a vehicle starting switch (not shown), and it generates an electro-magnetic force after the starting switch is turned on to be electrically energized. The fixed iron core 74 is installed at the upper end of the coil 73 and press-fitted to the opening part of the switch cover 72.

The plunger 75 is made of magnetic material. It is formed into a substantially columnar shape, arranged oppositely to the fixed iron core 74 within the hollow part of the coil 73 so that this plunger is attracted toward the fixed iron core 74 magnetized at the time of electrical energization. The return spring 76 is placed between the plunger 75 and the fixed iron core 74 at the inner periphery of the coil 73, so that the plunger 75 is normally biased downwardly (downward in FIG. 1) against the fixed iron core 74. That is, when the electrical energization for the coil 73 is terminated, the plunger 75 attracted toward the fixed iron core 74 against the biasing force of the spring 76 is returned back to the initial position (position shown in FIG. 1). The rod 77 is made of insulating material (resin, for example), fixed at the upper side of the plunger 75, passes through the hollow inner part of the coil 73, slidably passes through the through hole opened at the central part of the fixed iron core 74 and projects upwardly.

The contact part of the magnet switch 7 is comprised of a terminal bolt 78 fixed to the end cover 9; a fixed contact 79 fixed to the head part 78*a* of the terminal bolt 78; and a movable contact 71 connected to a lead line (pig-tail) 71*a* of the anode brush (not shown).

The terminal bolt 78 passes through the bottom wall of the end cover 9, and fixed to the end cover 9 by fastening a washer 93 with its extremity end side being exposed outside the end cover 9. The terminal bolt 78 is connected to an anode of the battery placed on the vehicle by a power supplying line (not shown). The fixed contact 79 is fixed to the head part 78*a* of the terminal bolt 78 within the end cover 9 by welding or the like.

The movable contact 71 is arranged in opposition to the fixed contact 79 and slidably fitted to the rod 77 of the magnet switch 7. A contact spring 70 is wound around the rod 77, its base end is fixed around the circle clip 701 fitted around the rod 77 and its biasing end biases the movable contact 71 toward the fixed contact 79. The extremity end of the rod 77 is formed with an engaging flange (not shown), so that the engaging flange prevents the movable contact 71 biased by contact spring 70 from being pulled off from rod 77.

To the bottom part of the plunger 75 is connected one end of a strap or cable member 5 made of a wire, for example, and the other end of the strap member 5 is fixedly connected to the short arm part 63 of the rotation restricting member 6. The strap member 5 axially passes outside the radial circumference of the brush holder 23, at an inner circumferential side of a yoke 24 of the starter motor 2 and between a pair of permanent magnetic poles (not shown), passes through a clearance between the center case 22 and the housing 8 and extends up in the housing 8. A roller supporting member 51 is fixed to the center case 22 so as to rotatably support the roller 52 for changing the direction of movement of the strap member 5. A roller 53 is rotatably supported at an inner circumferential surface of a peripheral wall of the end cover 9 and acts to change the direction of movement of the strap member 5.

With such an arrangement as above, as the attracting force of the magnet switch 7 (i.e., upward movement of plunger 75) acts on the rotation restricting member 6 through the strap member 5, the rotation restricting member 6 moves downwardly against a biasing force of the return spring (not shown). When the magnet switch 7 is turned off to diminish the attraction force, the member 6 moves upwardly by the biasing force of the return spring and returns back to its initial position (position shown in FIG. 1).

Then, an operation of the present embodiment will be described as follows.

In the present embodiment, the gap (b) between the indent 43*a* of the pinion 4 and the long arm 62 is set larger than a gap (a) between the movable contact 71 and the fixed contact 79. Thus, after the time that the movable contact 71 abuts against the fixed contact 79 and the starter motor 2 is electrically energized, the long arm 62 of the rotation restricting member 6 abuts or engages with the indent 43*a* of the pinion 4 so as to perform a rotational restriction on the pinion 4 which tends to rotate in correspondence to the motor rotation.

That is, when the starting switch is turned on by a driver, the coil 73 of the magnet switch 7 is electrically energized, the plunger 75 is magnetized and attracted upwardly against the biasing force of the spring 76.

With such an operation as above, the rod 77 integral with the plunger 75 enables the movable contact 71 to abut against the fixed contact 79 before the long arm 62 of the rotation restricting member 6 engages the indent 43*a*. As the plunger 75 is moved relatively to the movable contact 71 while compressing the contact spring 70, the strap member 5 is pulled toward the magnet switch 7. The rotation restricting member 6 is moved downwardly through the strap member 5, and the long arm 62 is engaged with the indent 43*a* arranged at the outer peripheral surface of the flange 43 of the pinion 4, whereby the rotation of the pinion 4 is restricted.

In addition, after the movable contact 71 and the fixed contact 79 are closely contacted to each other, the long arm 62 is engaged with the indent 43*a*. However, if the pinion 4 is being rotated before engagement between both members, the shock when engaged and friction between them become a problem. To obviate this problem, the above engagement is completed during the energization delay time of the motor 2 (normally, several to several tens milliseconds) from the contact closing time to the time at which the output shaft 3 actually starts to rotate.

The rotation of the armature of the starter motor 2 is decelerated by the planetary decelerating mechanism (not shown), and transmitted to the output shaft 3. The pinion 4 is also apt to be rotated due to the rotation of the output shaft 3. However, the pinion 4 is restricted in its rotation by the long arm 62, so that the rotational force of the output shaft 3 may act as a thrust for pushing the pinion 4 axially against the spring 32 by the helical spline mechanism. Thus, the pinion 4 advances along the helical spline and is engaged with the ring gear 100. Upon complete engagement of the pinion 4 with the ring gear 100, the long arm 62 of the rotation restricting member 6 is disengaged from the indent 43*a* and slides down behind the washer 45 to release the rotational restriction of the pinion 4. Thus, the pinion 4 is rotated together with the output shaft 3 and starts to drive the engine through the ring gear 100.

Under a state in which the pinion 4 advances forward and is engaged with the ring gear 100, the biasing force of the spring 32 arranged at the front end of the pinion 4 is increased. After starting cranking the engine, the pinion 4 is rotated by the ring gear 100, resulting in that the rotational force of the engine acts to retract the pinion 4 rearward under an action of the helical spline. The pinion 4 is apt to retract from the ring gear 100. However, when the pinion 4 is engaged with the ring gear 100, the rotation restricting member 6 is disengaged from the flange 43, pulled further downwardly by a remaining stroke of the plunger 75, and the restriction member 6 descends in a radial direction to be located axially rearwardly of the washer 45. At this time, when the pinion 4 tends to retract, the front end of the long arm 62 of the rotation restricting member 6 abut against the rear end surface of the washer 45, and the pinion 4 is prevented from being retracted rearwardly.

After this operation, as the starting switch is turned off and the electrical energization of the coil 73 of the magnet switch 7 is shut off, the electro-magnetic force of the coil 73 is diminished and the plunger 75 attracted against the fixed contact 74 up to that time is returned back to its initial position (moved downwardly as viewed in FIG. 1) by the biasing force of the return spring 76. As the plunger 75 returns to the initial lowermost position, the force for tensioning the rotation restricting member 6 is diminished through the strap member 5, so that the rotation restricting member 6 returns to the initial uppermost position (refer to FIG. 1) under a biasing of the return spring (not shown). As a result, the pinion 4 receiving the retracting force from the ring gear 100 is returned to the initial position (refer to FIG. 1).

In the present embodiment, the rotation of the output shaft 3 is directly transmitted to the pinion 4 through the helical spline-engagement. However, the rotation of the output shaft 3 may be transmitted to the pinion 4 through one-way clutch and, in this case, the long arm 62 of the rotation restricting member 6 may be abutted against the outer circumference of the one-way clutch so as to restrict the rotation of the pinion 4.

The period from the contact closing time in the magnet switch 7 to the time when either the pinion 4 or the output shaft 3 actually starts to rotate may include a case in which the pinion 4 starts a slight rotation (about one rotation from a stand-still state).

The present invention should not be limited to the disclosed embodiment but may be modified in various ways without departing from the spirit and scope of the invention.

What is claimed is:

1. A starter comprising:

a motor;

an output shaft driven by said motor;

a pinion moving member having a pinion fitted on said output shaft through a helical spline engagement for an engagement with and a disengagement from a ring gear of an engine;

a magnet switch having a plunger movable under an electrical energization of an exciting coil, and a movable contact movable toward a fixed contact under motion of said plunger, said magnet switch performing an electrical energization for said motor under an abutment of said movable contact against said fixed contact; and pinion restricting means for restricting rotation of said pinion through abutment to said pinion moving member by a movement of said plunger of said magnet switch and for enabling said pinion to move toward said ring gear through said helical spline, wherein said pinion restricting means is positioned to abut said pinion moving member after said movable contact of said magnet switch is abutted against said fixed contact and before a start of rotation of said pinion moving member by said output shaft.

2. A starter according to claim 1, wherein:

said pinion moving member has a plurality of grooves engageable with said pinion restricting means in addition to said pinion engageable with said ring gear.

3. A starter according to claim 1, wherein:

said pinion restricting means is adapted to move to a position for abutment with an axial end surface of said pinion moving member under movement of said plunger after a predetermined amount of movement of said pinion toward said ring gear.

4. A starter according to claim 2, wherein:

said pinion restricting means is adapted to move to a position for abutment with an axial end surface of said pinion moving member under movement of said plunger after a predetermined amount of movement of said pinion toward said ring gear.

5. A starter according to claim 1, further comprising:

a speed reducing mechanism which transmits rotation of said motor to said output shaft after reducing the rotation speed.

6. A starter according to claim 2, further comprising:

a speed reducing mechanism which transmits rotation of said motor to said output shaft after reducing the rotation speed.

7. A starter according to claim 3, further comprising:

a speed reducing mechanism which transmits rotation of said motor to said output shaft after reducing the rotation speed.

8. A starter according to claim 1, wherein:

a distance of movement of said pinion restricting means to said pinion moving member is set greater than that of movement of said movable contact to said fixed contact.

9. A starter according to claim 2, wherein:

a distance of movement of said pinion restricting means to said pinion moving member is set greater than that of movement of said movable contact to said fixed contact.

10. A starter according to claim 3, wherein:

a distance of movement of said pinion restricting means to said pinion moving member is set greater than that of movement of said movable contact to said fixed contact.

11. A starter according to claim 5, wherein:

a distance of movement of said pinion restricting means to said pinion moving member is set greater than that of movement of said movable contact to said fixed contact.

* * * * *